US007637220B2

(12) United States Patent
Fu

(10) Patent No.: US 7,637,220 B2
(45) Date of Patent: Dec. 29, 2009

(54) COLLAPSIBLE SHELF DEVICE

(76) Inventor: Kuang-Huan Fu, No. 318, Fu Te Rd., Su-ao Chen, Yilan Hsien (TW)

( * ) Notice: Subject to any disclaimer, the term of this patent is extended or adjusted under 35 U.S.C. 154(b) by 415 days.

(21) Appl. No.: 11/621,580

(22) Filed: Jan. 10, 2007

(65) Prior Publication Data

US 2008/0166503 A1 Jul. 10, 2008

(51) Int. Cl.
*A47B 3/00* (2006.01)

(52) U.S. Cl. ..... 108/163; 108/115; 108/170

(58) Field of Classification Search ..... 108/162, 108/163, 166, 167, 170, 115, 169, 187, 188; 211/201, 195, 149, 186; 16/365, 373, 366; 403/53, 54, 389, 391, 396; 280/42, 79.3, 280/47.35, 651, 639

See application file for complete search history.

(56) References Cited

U.S. PATENT DOCUMENTS

| | | | | | |
|---|---|---|---|---|---|
| 1,167,550 | A * | 1/1916 | Forsyth | ..... | 108/163 |
| 1,198,431 | A * | 9/1916 | Forsyth | ..... | 108/163 |
| 1,304,847 | A * | 5/1919 | Blais et al. | ..... | 108/163 |
| 3,093,247 | A * | 6/1963 | Erickson | ..... | 108/188 |
| 4,740,010 | A * | 4/1988 | Moskovitz | ..... | 280/641 |
| 5,131,547 | A * | 7/1992 | Goldberg | ..... | 211/149 |
| 5,823,100 | A * | 10/1998 | Wienhold et al. | ..... | 99/449 |
| 6,073,894 | A * | 6/2000 | Chen | ..... | 248/165 |
| 6,123,207 | A * | 9/2000 | Mast | ..... | 211/149 |
| 6,626,119 | B2 * | 9/2003 | Wilton | ..... | 108/118 |
| 7,389,887 | B2 * | 6/2008 | Liang | ..... | 211/149 |
| 2002/0109441 | A1 * | 8/2002 | Wang | ..... | 312/258 |

FOREIGN PATENT DOCUMENTS

JP 2004215816 * 8/2004

* cited by examiner

*Primary Examiner*—Janet M Wilkens
(74) *Attorney, Agent, or Firm*—Leong C. Lei

(57) ABSTRACT

The shelf device mainly contains two rectangular top boards horizontally arranged side by side on top of a frame structure formed by at least three vertical and two horizontal frame members. Each vertical frame member has a number of horizontal beams each horizontal frame member has its two shorter edges hinged to the horizontal beams of two vertical frame members at the two sides of the horizontal frame member. The shelf device can be easily collapsed by lifting a handle on the top edge of the vertical frame member in the middle. When that happens, due to the way the vertical and horizontal frame members are hinged together, the top board and frame structure at the two sides of the shelf device are automatically closed towards each other. At last, the shelf device becomes a flat object for easy storage and carry.

4 Claims, 7 Drawing Sheets

COLLAPSIBLE SHELF DEVICE

TECHNICAL FIELD OF THE INVENTION

The present invention generally relates to shelves, and more particularly to a shelf device that can be collapsed into a flat object for easier carry and storage when not in use.

DESCRIPTION OF THE PRIOR ART

A shelf is usually rigidly structured such that it is very difficult to move and takes up quite some space, especially when it is not in use. Therefore, some assembly-type or collapsible shelve devices are developed. However, these collapsible shelf devices usually contain a great number of parts and are complicatedly structured. A novice user has to spend significant amount of effort and time to get the device assembled and disassembled.

SUMMARY OF THE INVENTION

The primary purpose of the present invention is to provide a novel collapsible shelf device which, when not in use, can be collapsed into a flat object for easier carry and storage.

The shelf device mainly contains two rectangular top boards horizontally arranged side by side on top of a frame structure formed by at least three vertical and two horizontal frame members. Each vertical frame member has a number of horizontal beams. Each horizontal frame member has its two shorter edges hinged to the horizontal beams of two vertical frame members at the two sides of the horizontal frame member.

The vertical frame member in the middle has an inverse U-shaped handle arranged along the top edge, extending out between the top boards. The shelf device can be easily collapsed by lifting the handle upward. When that happens, due to the way the vertical and horizontal frame members are hinged together, the top boards and the frame structure at the two sides of the vertical frame member in the middle are automatically closed towards each other. At last, the shelf device becomes a flat object for easy storage and carry.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
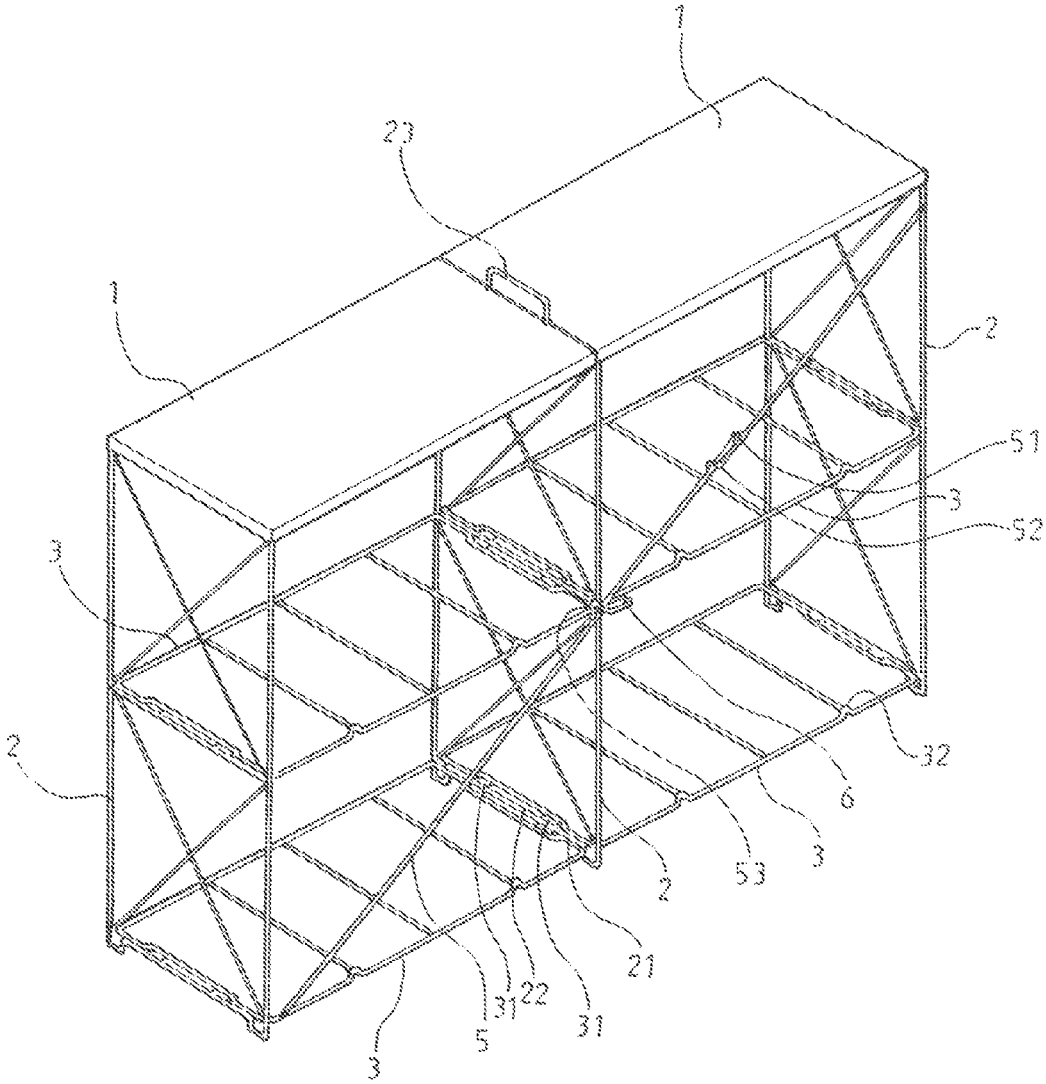
FIG. 1 is a perspective schematic view showing the shelf device according to an embodiment of the present invention when the shelf device is assembled.
Figure 2:
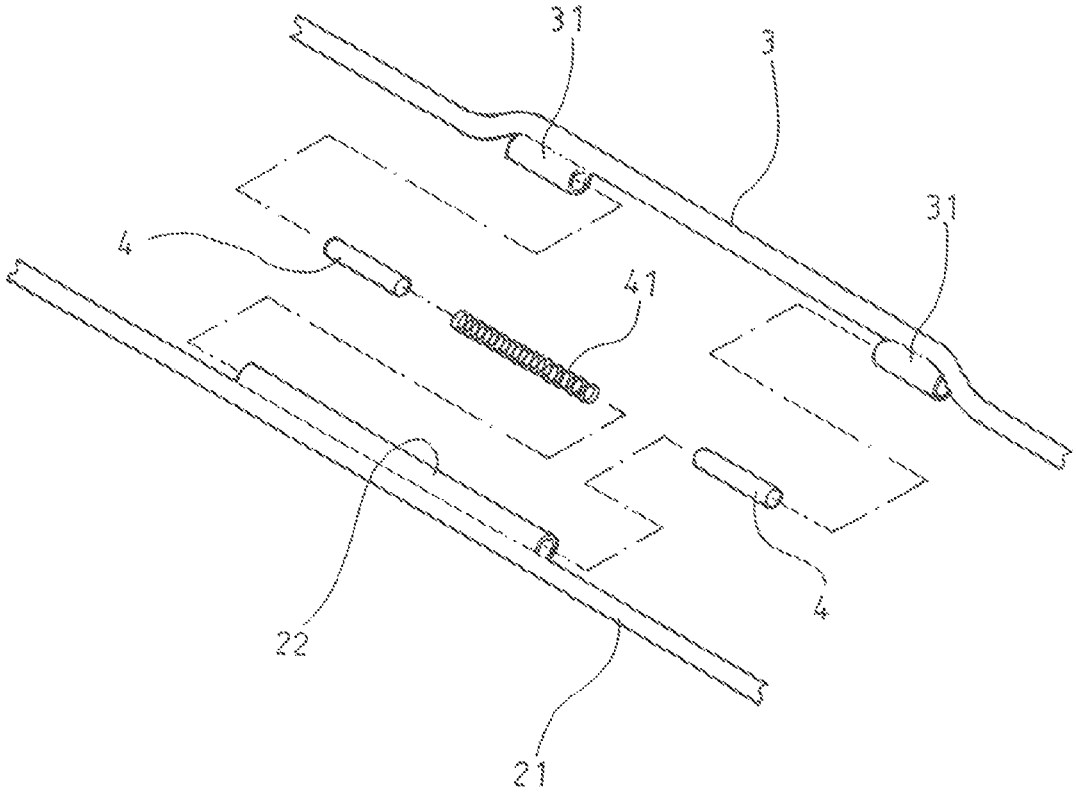
FIG. 2 is a perspective schematic view showing the assembly of the vertical and horizontal frame members of the shelf device of FIG. 1.
Figure 3:
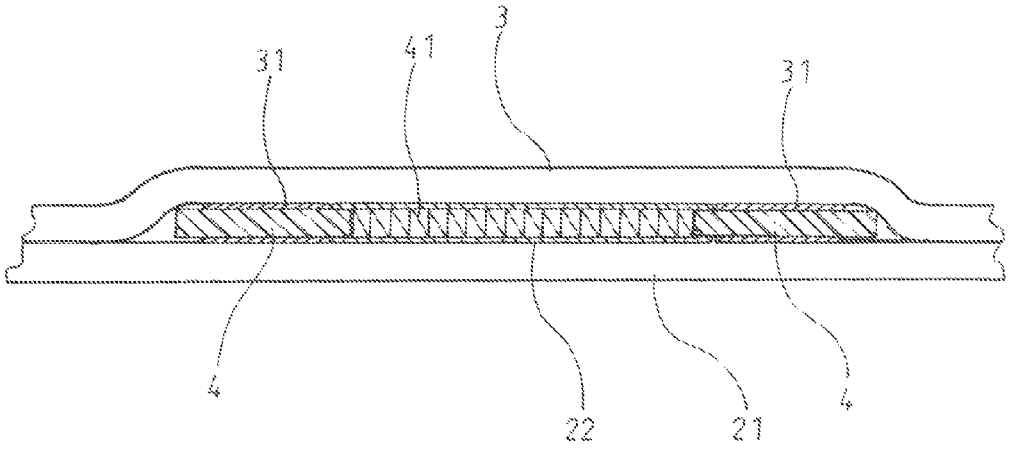
FIG. 3 is a sectional schematic view showing how the vertical and horizontal frame members of FIG. 2 are hinged together.

As shown in FIG. 1, the shelf device according to an embodiment of the present invention mainly contains two rectangular top boards 1 horizontally arranged side by side on top of a frame structure. The frame structure contains a number of rectangular vertical frame members 2 and horizontal frame members 3. In the present embodiment, there are three vertical frame members and four horizontal frame member 3 (at least two horizontal frame members are required). As further shown in FIG. 2, for the vertical frame members 2 at the sides of the shelf device, each has a number of horizontal beams 21. A shorter tubular element 22 is fixedly and horizontally attached to the body of the horizontal beam 21. When the shelf device is assembled, the vertical frame members 2 at the two sides should be arranged so that their tubular elements 22 are inside the shelf device. For the vertical members 2 in the middle, each horizontal beam 21 has two tubular elements 22 horizontally arranged along the horizontal beam 21. Within each tubular element 22, a resilient element 41 (such as a helix spring) is housed with two pins 4 at its two ends, respectively. On the other hand, each horizontal frame member 3 has its two shorter edges indented for an appropriate length. Within the indentation, two tubular elements 31 are horizontally attached to the indented section of the edge of the horizontal member 3 such that the tubular element 22 can fit between the two tubular elements 31. As further shown in FIG. 3, due to the resilience of the resilient element 41, the two pins 4 are threaded into the two tubular elements 31, respectively. The two pins 4 are then stopped by the corners of the indentation so that they will not fall out of the other ends of the tubular elements 31. In other words, each horizontal frame member 3 has its two shorter edges hinged to the horizontal beams 21 of two vertical frame members 2 at the two sides of the horizontal frame member 3. Each horizontal frame member 3 has a number of bulges 32 along the longer edge on a back side of the shelf device as stoppers for the objects supported on the horizontal frame member 3.

Figure 4:
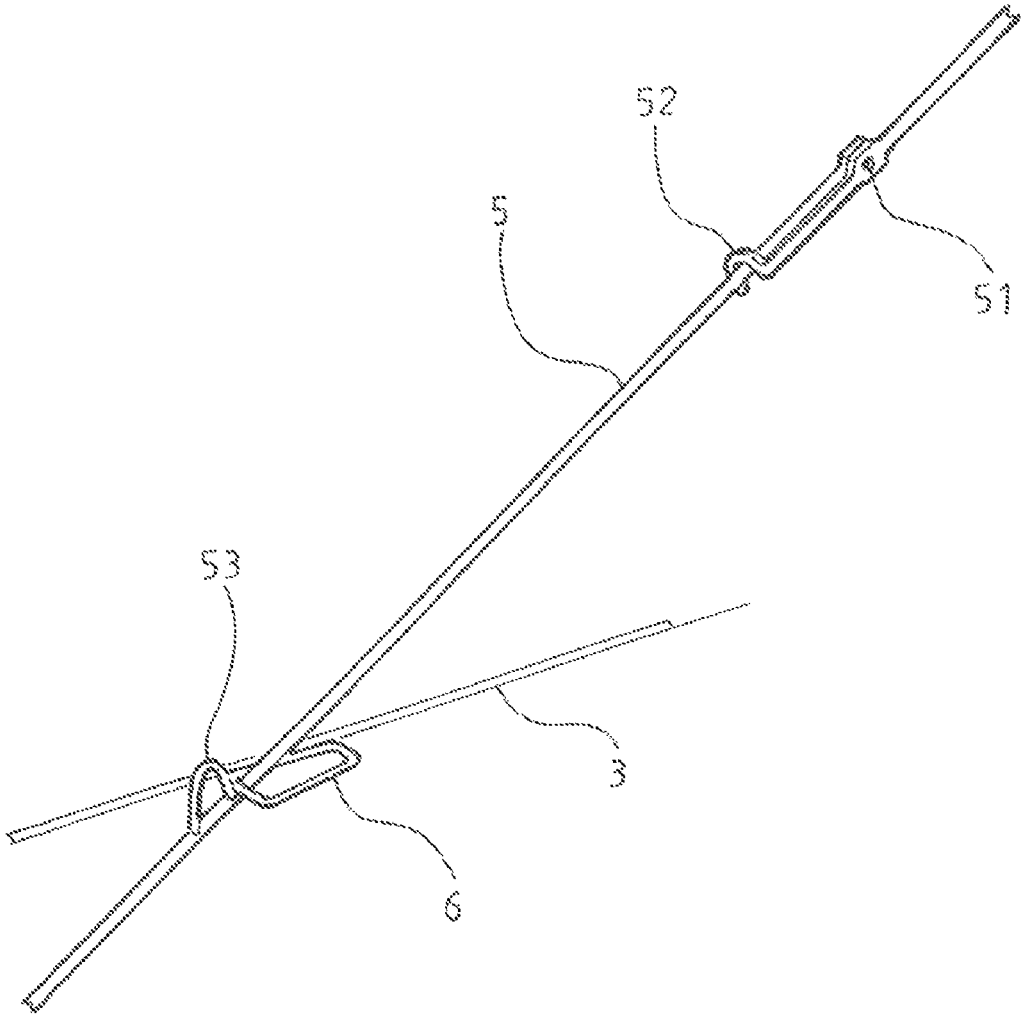
FIG. 4 is a perspective schematic view showing the diagonal brace of the shelf device of FIG. 1.

The vertical frame member 2 in the middle has an inverse U-shaped handle 23 arranged along the top edge, extending out between the top boards 1. Also at an appropriate location along the longer edge of the vertical frame member 2 on the back side of the shelf device, there is a horizontal ring 6 for a diagonal brace 5 to run through on the back side of the shelf device from an upper corner of a vertical frame member 2 at one side to a lower corner of another vertical frame member 2 at the other side. As shown in FIG. 4, the diagonal brace 5 actually contains two sections joined by a hinge 51 at an appropriate location along its body. One of the sections has its end extended beyond the hinge 51 for an appropriate length with a hook 52 at the tip around the body of the other section. As such, the diagonal brace 5 can only be bended in one direction. On the other hand, the other section has a loop 53 along its body to be against the ring 6.

Figure 5:
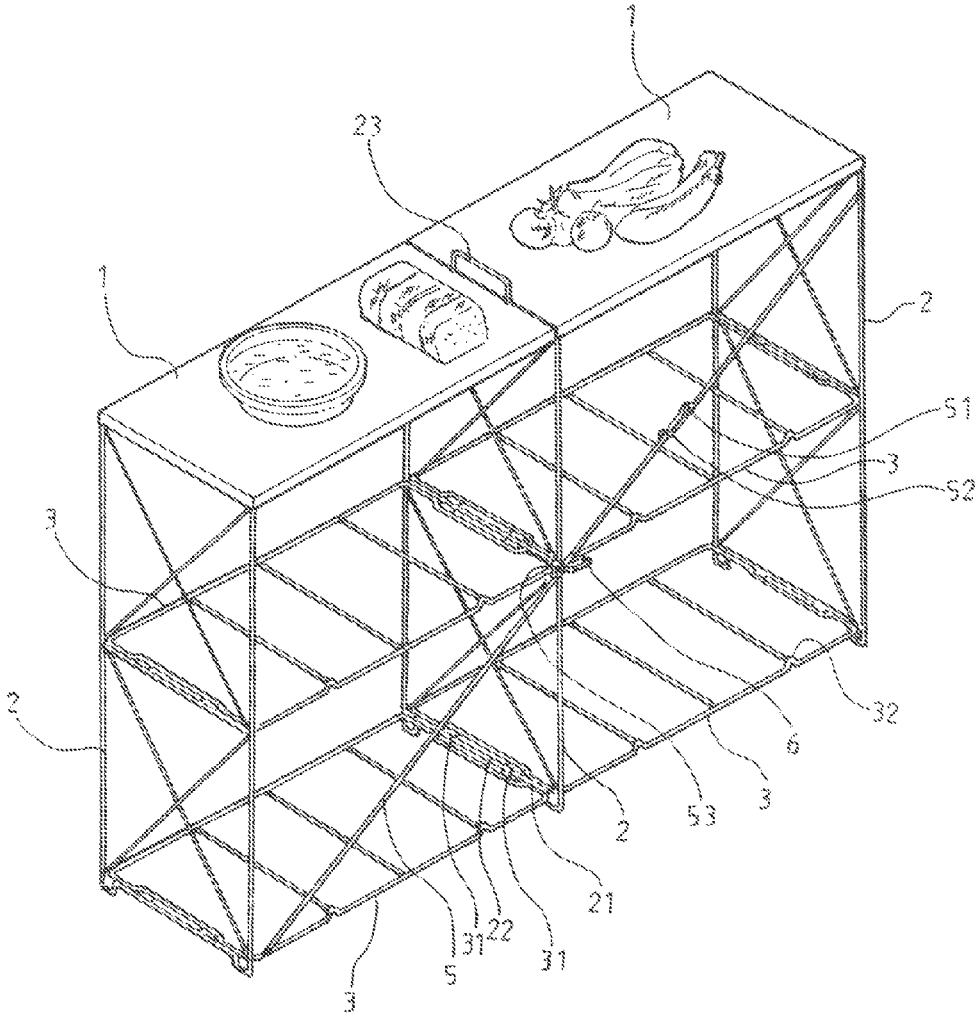
FIG. 5 is a perspective schematic view showing an application scenario of the shelf device of FIG. 1.
Figure 6:
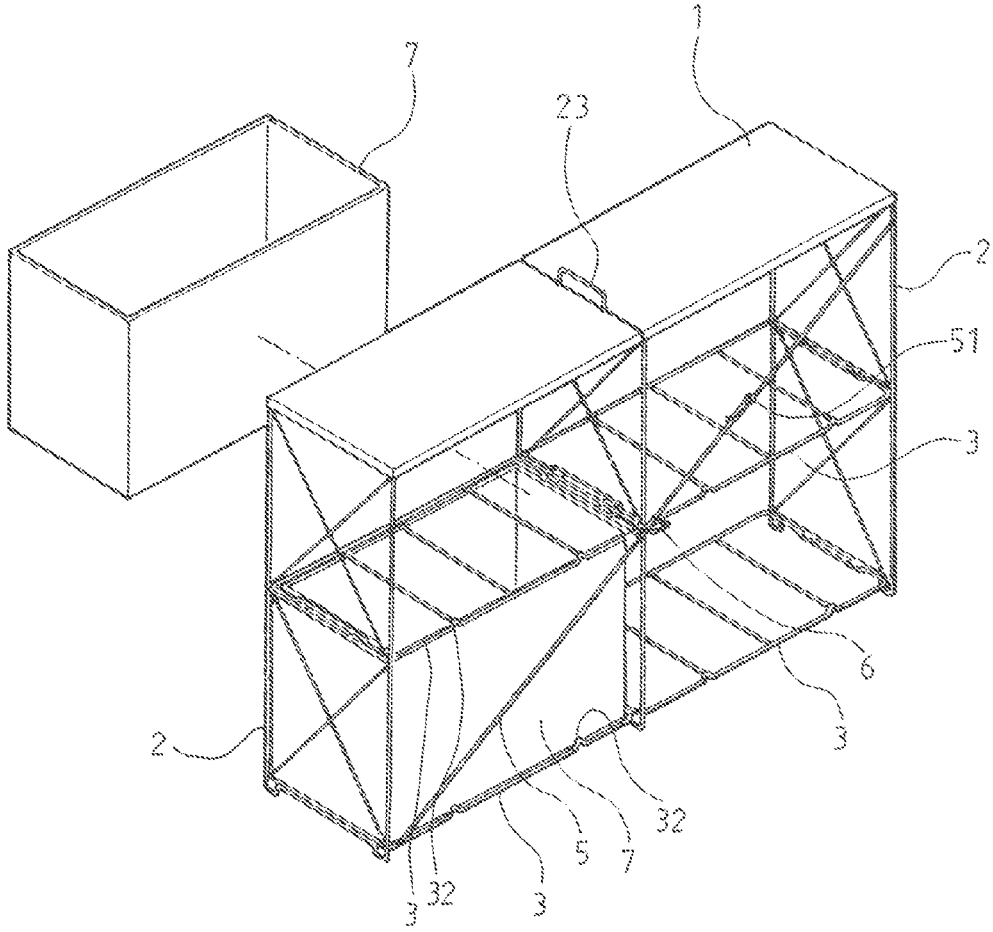
FIG. 6 is a perspective schematic view showing another application scenario of the shelf device of FIG. 1.

As shown in FIGS. 5 and 6, when the shelf device is put to use according to the foregoing description, the top boards 1 and the horizontal frame members 3 provides supports for the objects placed on them. Please pay special attention to the diagonal brace 5. The diagonal brace 5, by the locking of the hook 52 and the interaction between the loop 53 and the ring 6, reinforces the strength of the frame structure significantly. If required, appropriate sized storage boxes 7 can be placed inside the individual spaces framed by the vertical and horizontal frame members 2 and 3, respectively. The bulges 32 along the back side of the shelf device prevent the boxes 7 from falling off the shelf device.

Figure 7:
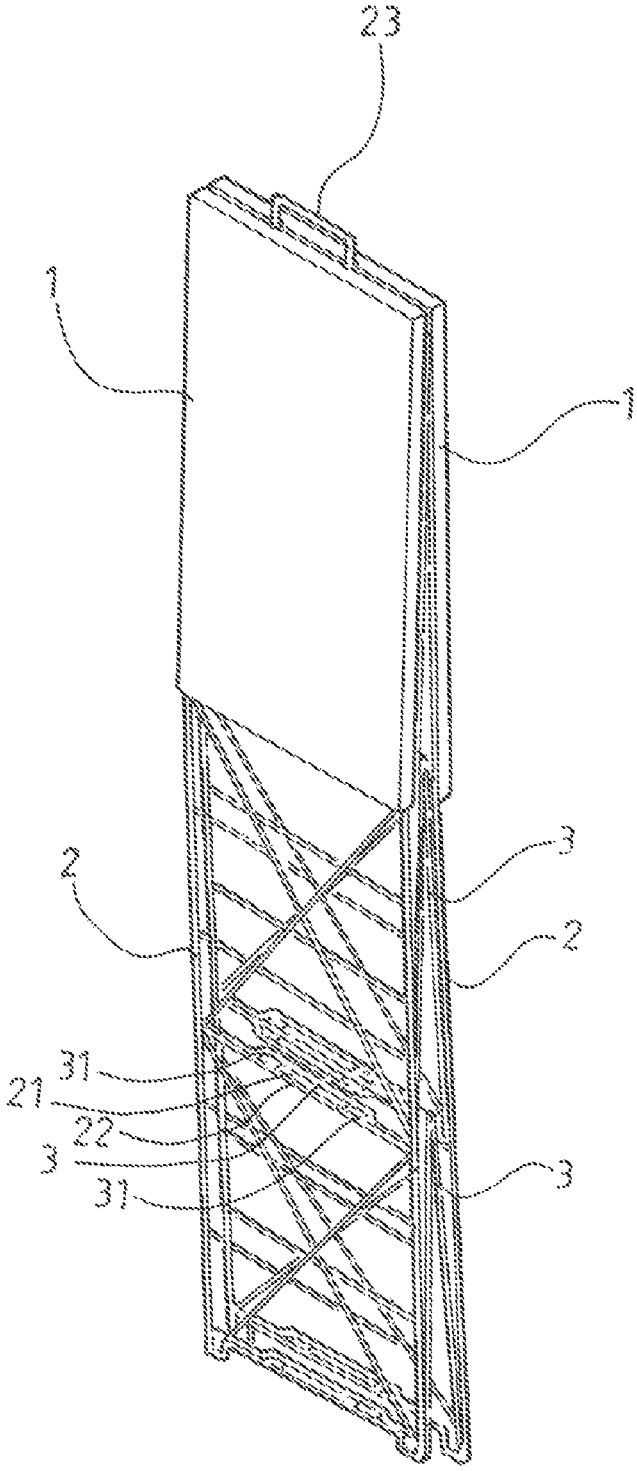
FIG. 7 is a perspective schematic view showing the shelf device of FIG. 1 when it is collapsed.

As shown in FIG. 7, after the shelf device is emptied, the shelf device can be easily collapsed by lifting the handle 23 upward. When that happens, due to the way the vertical and horizontal frame members 2 and 3 are hinged together, the shelf device at the two sides of the shelf device are automatically closed towards the vertical frame member 3 in the middle. In the mean time, the hook 52 is released and the diagonal brace 5 is bended automatically. At last, the entire shelf device becomes a flat object which can be easily stored and carried.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A collapsible shelf device comprising:

three rectangular vertical frame members positioned upright in parallel, each of said vertical frame members having a plurality of horizontal beams, each of said horizontal beams having at least a first tubular element arranged along said horizontal beam facing another first tubular element of an adjacent one of said vertical frame members;

two rectangular horizontal frame members, each of said horizontal frame members having the shorter edges indented within which two second tubular elements are horizontally attached with an appropriate distance therebetween to accommodate said first tubular element of a respective one of said vertical frame members so that said first and second tubular elements are hinged;

two boards, fixedly positioned side by side between the top edges of two of said vertical frame members respectively; and a diagonal brace running along a back side of said shelf device from an upper corner of a first one of said vertical frame members at one side to a lower corner of a second one of said vertical frame members at the other side of said shelf device;

wherein, when a third one of said vertical frame members in the middle is lifted upward, said boards, and said vertical and horizontal frame members at the two sides of said shelf device are automatically closed towards said third one of said vertical frame members in the middle.

2. The collapsible shelf device according to claim 1, wherein each of said first tubular elements houses a resilient element and two pins at the two ends of said resilient element, respectively.

3. The collapsible shelf device according to claim 1, wherein said vertical frame member in the middle has a handle along the top edge of said vertical member, extending out between said boards for lifting up said vertical frame member in the middle.

4. The collapsible shelf device according to claim 1, wherein said vertical frame member in the middle has a horizontal ring at an appropriate location along the longer edge on said back side of said shelf device for said diagonal brace to run through; and said diagonal brace has a loop for against said ring.

* * * * *